US008651201B2

(12) United States Patent
Hollier

(10) Patent No.: US 8,651,201 B2
(45) Date of Patent: Feb. 18, 2014

(54) DRILL CUTTINGS BOX COMBINED CUTTINGS FEED INLET AND AIR OUTLET APPARATUS

(75) Inventor: Chad Hollier, Lafayette, LA (US)

(73) Assignee: Environmental Drilling Solutions, LLC, Lafayette, LA (US)

( * ) Notice: Subject to any disclaimer, the term of this patent is extended or adjusted under 35 U.S.C. 154(b) by 201 days.

(21) Appl. No.: 13/104,592

(22) Filed: May 10, 2011

(65) Prior Publication Data

US 2012/0031680 A1 Feb. 9, 2012

Related U.S. Application Data

(60) Provisional application No. 61/370,700, filed on Aug. 4, 2010.

(51) Int. Cl.
*E21B 21/06* (2006.01)

(52) U.S. Cl.
USPC ..... 175/206; 175/207

(58) Field of Classification Search
USPC ..... 175/206, 207, 66
See application file for complete search history.

(56) References Cited

U.S. PATENT DOCUMENTS

| | | | | |
|---|---|---|---|---|
| 5,971,084 | A | 10/1999 | Dietzen | |
| 6,170,580 | B1 * | 1/2001 | Reddoch | 175/66 |
| 6,681,874 | B2 * | 1/2004 | Risher et al. | 175/66 |
| 7,025,153 | B2 * | 4/2006 | Boutte et al. | 175/66 |
| 7,093,678 | B2 * | 8/2006 | Risher et al. | 175/66 |
| 7,195,084 | B2 * | 3/2007 | Burnett et al. | 175/66 |
| 7,484,574 | B2 * | 2/2009 | Burnett et al. | 175/66 |
| 7,493,969 | B2 * | 2/2009 | Burnett et al. | 175/88 |
| 8,322,464 | B2 * | 12/2012 | Reddoch, Sr. | 175/66 |

* cited by examiner

*Primary Examiner* — Giovanna Wright
(74) *Attorney, Agent, or Firm* — Law Office of Jesse D. Lambert, LLC

(57) ABSTRACT

A combined cuttings stream inlet and air stream outlet apparatus, for placement within the inspection hatch of a conventional drill cuttings box, is disclosed. The combined cuttings stream inlet and air stream outlet apparatus has a central cuttings stream inlet conduit, disposed within a larger air stream outlet conduit. The air stream outlet conduit is sized to closely engage the diameter of the inspection hatch when inserted into the hatch opening. The annulus between the two conduits forms a flow area for air to exit the cuttings box. In use, the combined apparatus is easily inserted into the hatch opening of the cuttings box, preferably with a gasket between the apparatus and the hatch opening, and is held in place by the cuttings/air stream. When the cuttings box is full, the apparatus is simply pulled out and inserted into an empty cuttings box.

8 Claims, 6 Drawing Sheets

32
32
34
30
21
21
22
10
20

30
34
32
10
21
21
22
20
22

DRILL CUTTINGS BOX COMBINED CUTTINGS FEED INLET AND AIR OUTLET APPARATUS

CROSS REFERENCE TO RELATED APPLICATIONS

This United States regular patent application claims priority to U.S. provisional patent application Ser. No. 61/370,700, filed Aug. 4, 2010, for all purposes.

BACKGROUND

1. Field of the Invention

This invention relates, generally, to apparatus commonly (but not exclusively) used in connection with the drilling of oil and gas wells. More particularly, this invention relates to an apparatus used in combination with commercially available drill cuttings boxes, which enables the user to easily and quickly shift the drill cuttings inlet to successive drill cuttings boxes as the boxes are filled, with greatly increased safety and efficiency.

2. Related Art

In the course of drilling a well (whether an "oil well" or "gas well"), a volume of "drill cuttings" are generated—namely, the earth that is removed from the ground in the course of drilling the earthen borehole. As is well known in the field of rotary drilling, the earth is brought to the surface in the form of small "drill cuttings" or "cuttings," carried in the stream of drilling fluid, typically a liquid "drilling mud." The combined drilling mud/drill cuttings stream is processed (by shakers and other equipment well known in the relevant art) so as to remove the drill cuttings and route the drilling mud for circulation back downhole.

On many drilling locations, the drill cuttings must be transferred to large boxes, which by way of example may have a capacity of 25 oil field barrels and are typically made of metal, known as "cuttings boxes," for disposal away from the drilling location. As can be seen in FIG. 1, a typical cuttings box is a generally elongated box having at least one top hinged lid, and a hinged relief hatch. The lid is bolted shut with a number of nuts and bolts, and is quite heavy, typically 80 to 100 lbs. To open the lid for access to the interior of the cuttings box, all of the bolts must be removed (which is time consuming), and the lid rotated back on its hinges. Due to the weight of the lid, and the various pinch points presented, a number of accidents have occurred in the lid manipulation process, given that workers are typically in a hurry to get lids opened and closed. In addition, at least two workers are generally needed to perform the lid opening and/or closing.

While various means of transferring the cuttings into the cuttings boxes are used, one common system is a vacuum system. Vacuum systems use a high volume air stream at pressures typically slightly below atmospheric, which pull the drill cuttings from the rig through a pipe, hose or other conduit, to a cuttings box, where the drill cuttings fall out in the cuttings box and air is discharged or pulled from the cuttings box through an air outlet and a hose to the vacuum source.

Current vacuum systems utilize a so-called "false lid" having two conduits or hoses connected thereto: a cuttings inlet hose running from the cuttings source to the cuttings inlet on the false lid, and an air outlet hose running from the air outlet on the false lid to the vacuum source. In the prior art systems, the cuttings box lid must be opened as described above and rotated back. The false lid (which itself is large and heavy) is then installed over the resulting lid opening. Cuttings are pulled through the inlet hose in the vacuum air stream; the cuttings then enter the cuttings box through a cuttings inlet and drop into the cuttings box, and air is discharged from the box through an air outlet and the outlet hose, typically next through an air buffer tank (in which drops out any further cuttings or liquids) and thence to the vacuum source. During periods of drilling which generate a high volume of drill cuttings, boxes may fill every 10 to 15 minutes. As a result, the false lid must be removed from the cuttings box; the lid rotated closed and bolted shut; the lid on an empty cuttings box opened and the false lid installed, and cuttings received into the new empty box. Suffice to suggest that this process must be repeated in rapid sequence, at perhaps 10 to 15 minute intervals during periods of high cuttings volume, and the opportunity for injuries is correspondingly high. At times, drilling must be halted while cuttings boxes and the related equipment can be changed, with a resulting loss of efficiency and incursion of related costs.

SUMMARY

The present invention provides a very much quicker, simpler and safer means of coupling cuttings inlet hoses and inlets, and air outlet hoses and air outlets, to closed cuttings boxes, while requiring no modification of the cuttings boxes and requiring less manpower. A closed drill cuttings box combined cuttings feed inlet and air outlet device, referred to at times as the combined inlet/outlet device, fits into the inspection hatch opening on a typical cuttings box and extends down into the cuttings box. The cuttings/air stream feed inlet hose and the air stream outlet hose are both coupled to the combined inlet/outlet device. The cuttings/air stream enters the cuttings box, the cuttings fall out and remain in the cuttings box, while the air stream continues out the outlet, typically to a buffer tank, and then to the vacuum source. The inlet and outlet flow areas (cross section areas) of the combined inlet/outlet device are arranged so as to maximize use of the available cross section area of the inspection hatch opening. One arrangement embodying the principles of the present invention is an annular arrangement, where the inlet and outlet are positioned one inside the other, which may be via concentrically positioned conduits. One flow conduit, typically the cuttings inlet, carries the center flow stream, and the other flow conduit (typically the air outlet) is disposed annularly around the cuttings inlet (although it is understood that the two flow areas could be reversed, with the discharge taking the central flow area). This embodiment may be comprised of concentric circular conduits. Other arrangements of the inlet and discharge areas are possible, while maximizing usage of the available inspection hatch cross section area.

DESCRIPTION OF THE PRESENTLY PREFERRED EMBODIMENT(S)

While various embodiments of the present invention are possible, with reference to the drawings some of the presently preferred embodiments can now be described.

Figure 1:
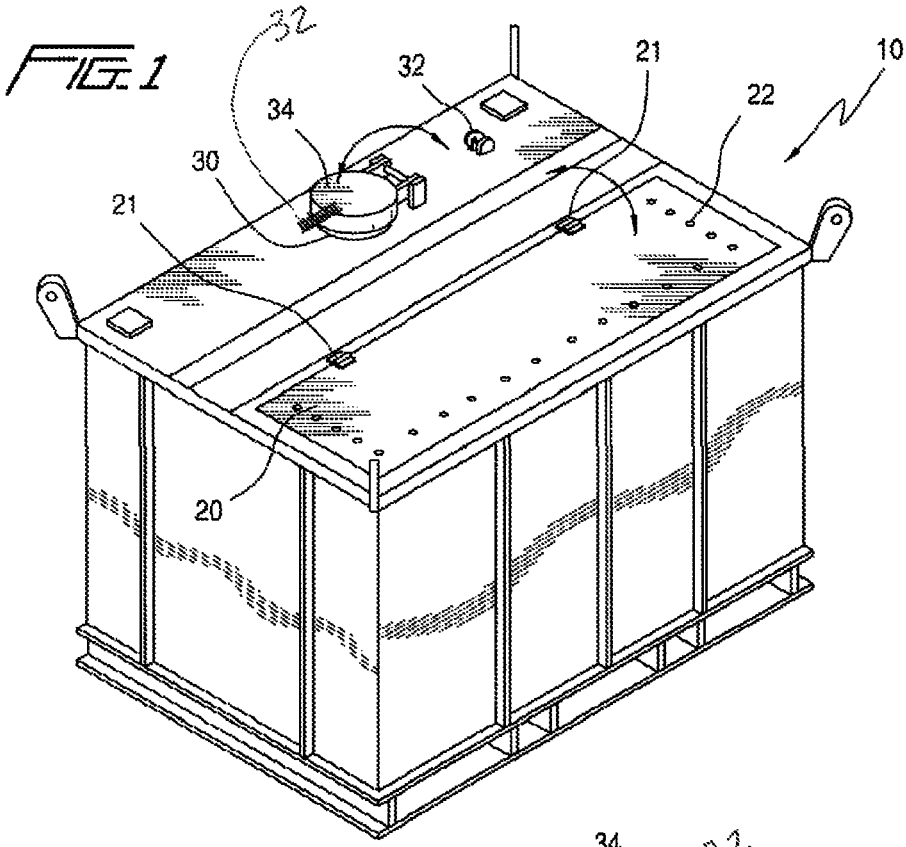
FIG. 1 is a perspective view of a typical cuttings box.
Figure 2:
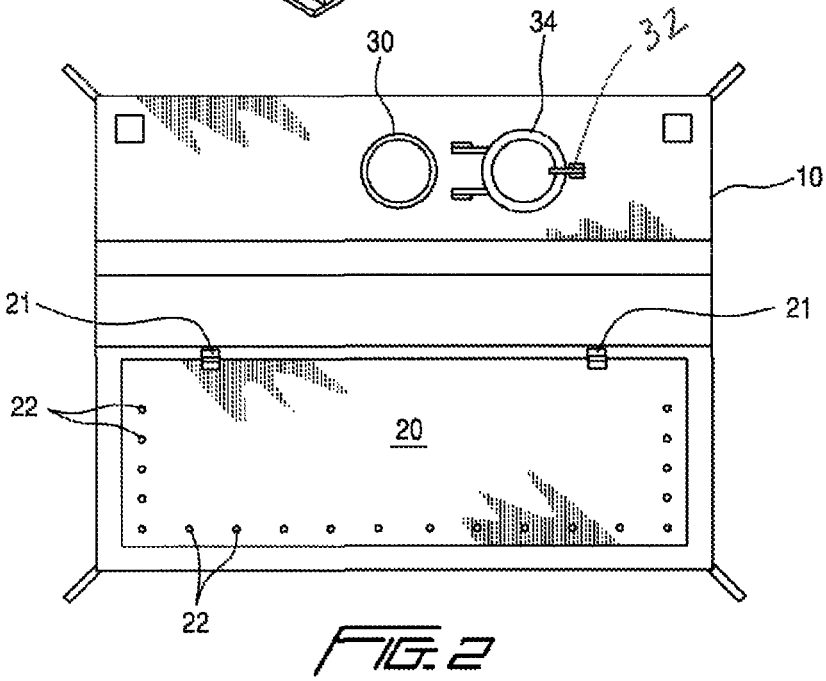
FIG. 2 is a top view of the cuttings box of FIG. 1.

FIG. 1 is a perspective view of a typical, commercially available drill cuttings box, referred to herein as a cuttings box 10. Cuttings box 10 is typically an elongated, closed metal box, which may be equipped with padeyes, etc. for handling with a sling, etc. As can be seen in FIGS. 1 and 2, cuttings box 10 comprises a box lid 20 on the top surface, spanning approximately one half of the top surface area. Box lid 20 is typically hinged by hinges 21, and is bolted closed by bolts and nuts 22 around its perimeter. It can be understood that in order to open box lid 20, bolts 22 must first be removed (by hand wrenches, air wrenches, etc.), then the lid rotated back on hinges 21.

Cuttings box 10 further comprises a relief or inspection hatch, with a lid 34 and an opening 30, with hatch lid 34 rotatably attached to box 10. A latch means 32 can lock hatch lid 34 in a closed position. In contrast to box lid 20, which is relatively large and can weigh 80 to 100 pounds, hatch lid 34 is much smaller and lighter. As a result, hatch lid 34 can be quite quickly and easily unlocked via latch means 32, rotated open, rotated closed and latched closed when desired. When hatch lid 34 is opened, a hatch opening 30 provides access to the interior of cuttings box 10.

Figure 3:
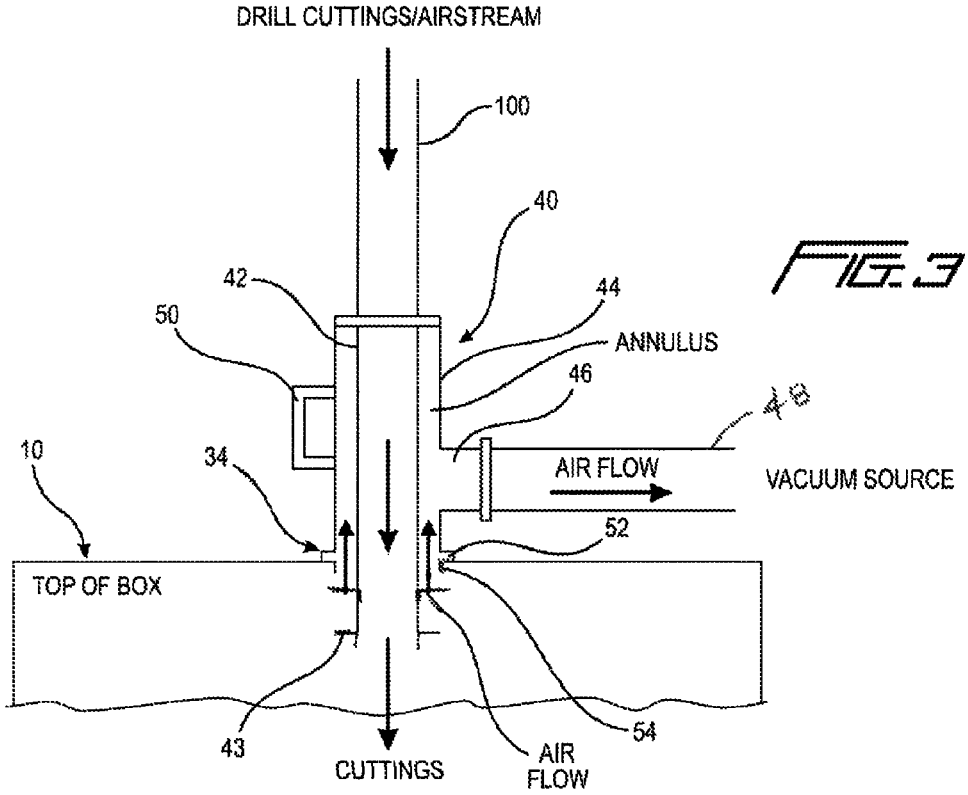
FIG. 3 is a side cutaway view of the closed cuttings box combined cuttings feed inlet and annular air outlet apparatus, embodying the principles of the present invention, mounted on a cuttings box.

Combined cuttings feed stream inlet and air outlet apparatus, referred to at times herein as hereinafter as "feed inlet," 40, is shown in FIG. 3. Feed inlet 40 comprises an inlet conduit 42, to which is connected to a means for connecting the cuttings feed inlet to a cuttings source, typically a cuttings hose 100. Inlet conduit 42 runs through a generally cylindrical outlet conduit 44, which is of a larger diameter; it is understood that an annulus thereby exists between the outer diameter of inlet conduit 42 and the inner diameter of outlet conduit 44. The annulus is closed at the upper end of outlet conduit 44 (as oriented in FIG. 3). It is understood that the drill cuttings flow through inlet conduit 42 into cuttings box 10, as later described.

Outlet conduit 44 has a discharge opening 46, typically connected to a means for connecting the air stream outlet to a vacuum source, typically an air vacuum hose 48. Vacuum hose 48 in turn connects to a vacuum source, which pulls a desired volume rate of air through the system. The apparatus comprises a means for attaching feed inlet 40 to cuttings box 10, which in one presently preferred embodiment comprises a collar 52 with a means for at least partially sealing outlet conduit 44 within hatch opening 30, which may comprise circumferential gasket 54. As shown in FIG. 3, inlet 42 (which may comprise one or more lower collar or baffles 43) is inserted through relief hatch opening 30 and preferably extends some distance into box 10.

Outlet conduit 44 has an outer diameter which is adapted to fit closely in relief hatch opening 30, as seen in FIG. 3. Gasket 54 seals outlet conduit 44 within relief hatch opening 34, so that no air can flow into or out of tank 10 around outlet conduit 44. Baffle 43 serves to reduce any tendency for the cuttings stream to be pulled directly from the outlet of cuttings inlet 42, into the outlet conduit 44. As shown on the drawings, the positioning of the bottom end of cuttings inlet conduit 42 spaced vertically downward from the top of box 10 also helps to reduce the tendency for cuttings to be pulled into outlet conduit 44. It can be readily understood that the combined cross section areas of inlet 42 and outlet 44 maximize use of the available cross section area of hatch opening 30.

Figure 4:
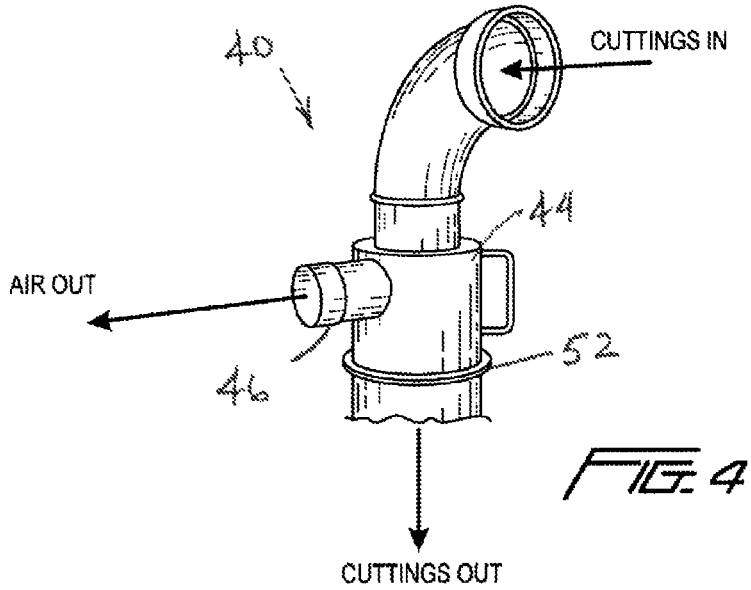
FIG. 4 is a perspective view of the closed cuttings box combined cuttings feed inlet and annular air outlet apparatus.
Figure 5:
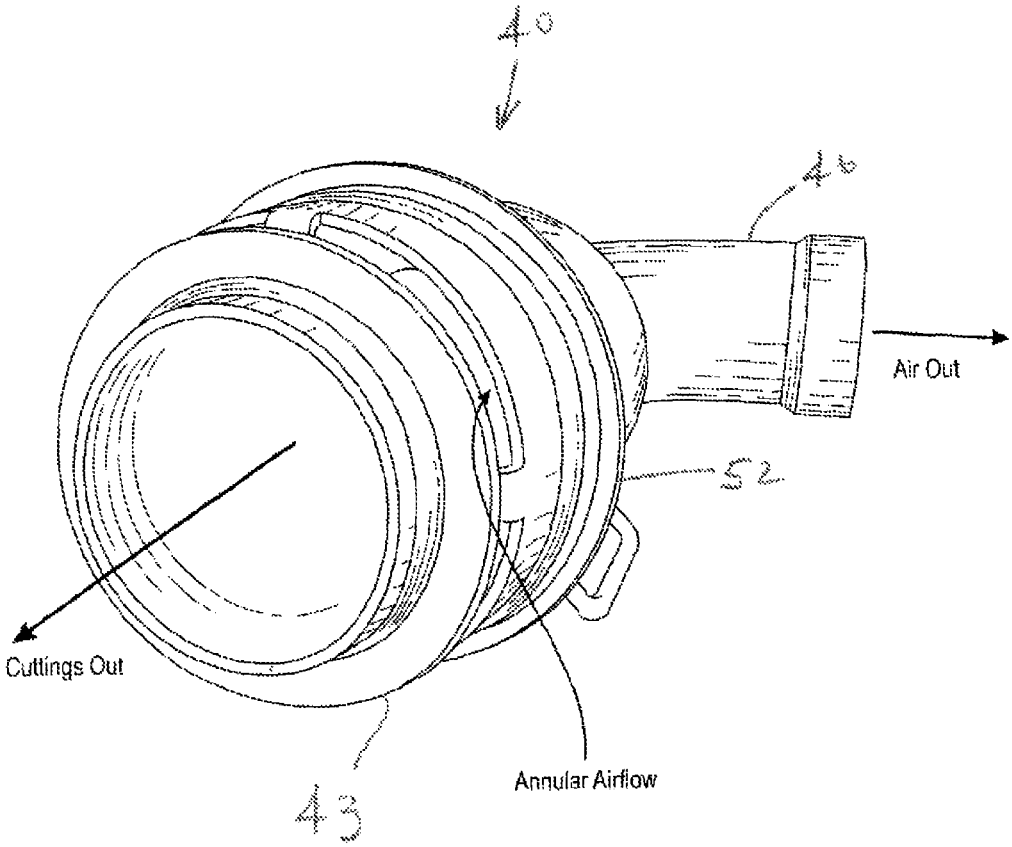
FIG. 5 is a bottom view of the cuttings box feed inlet of FIG. 3, showing the annular air flow space.

FIG. 4 is a perspective view of feed inlet 40. FIG. 5 is another perspective view from the bottom, underside or lower end of feed inlet 40, showing the flow paths of the different fluid streams.

Figure 6:
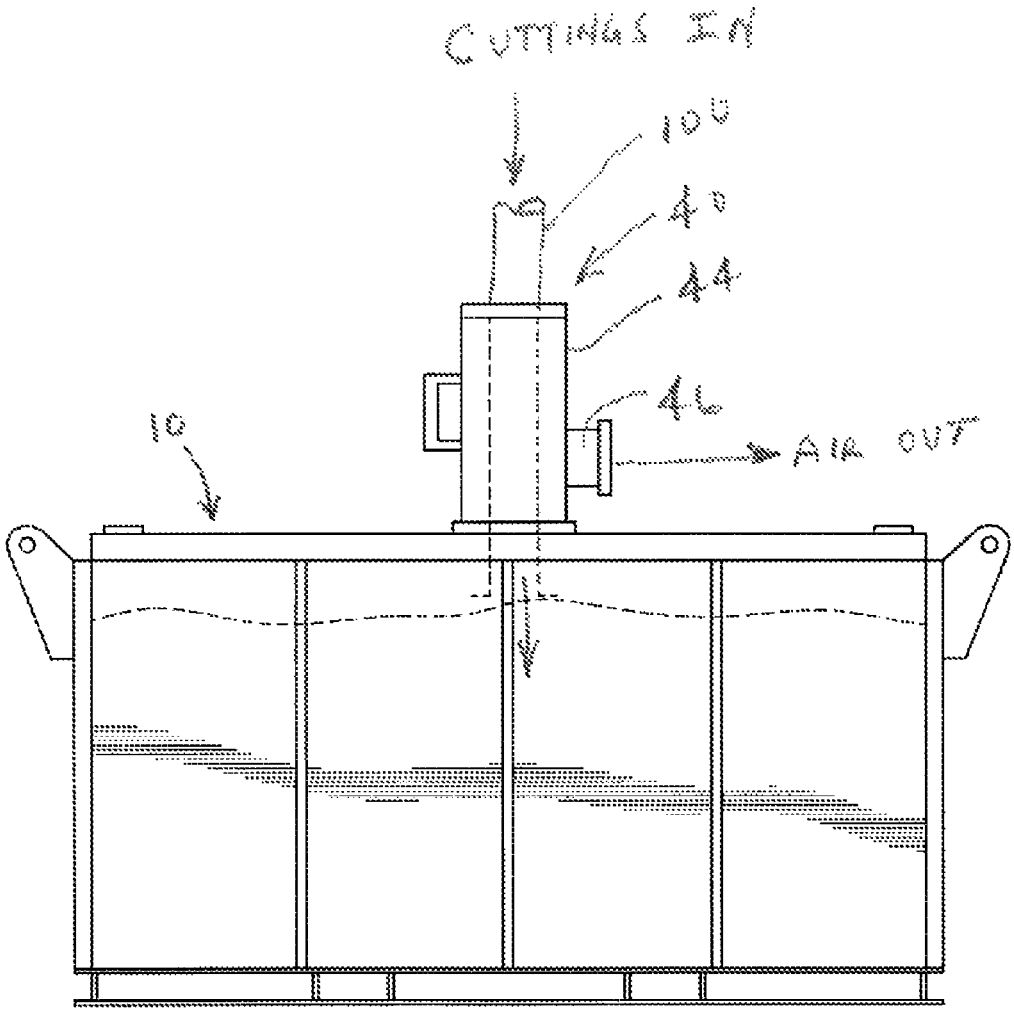
FIG. 6 is a side view of the cuttings box feed inlet of FIG. 3, shown mounted on a cuttings box.

FIG. 6 is a partial cutaway view showing feed inlet 40 mounted on cuttings box 10.

Figure 7:
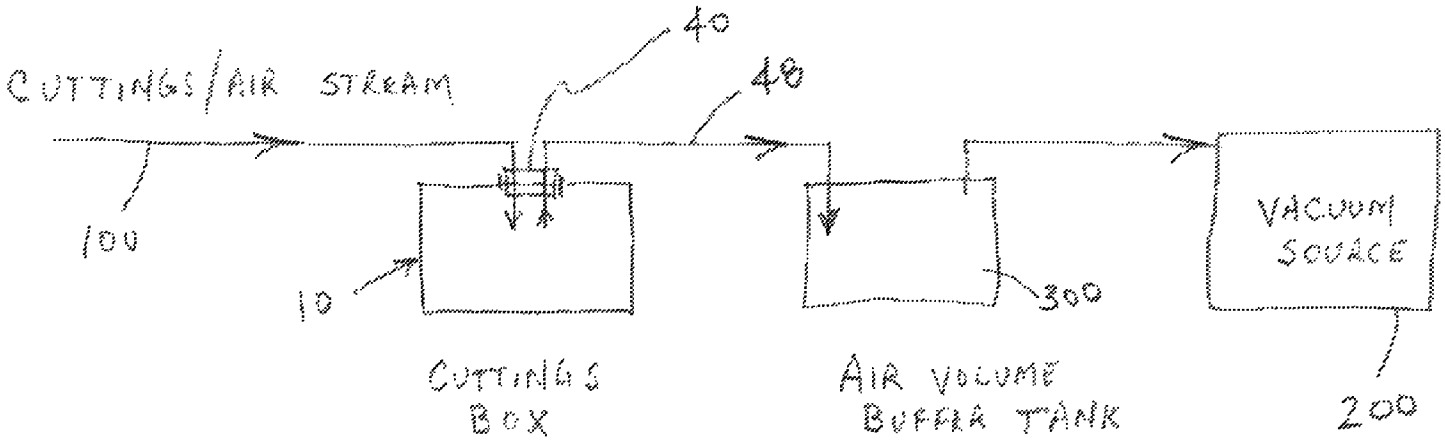
FIG. 7 is a simplified schematic showing the overall cuttings/air flowstream path.

FIG. 7 is a simplified schematic of a system showing use of feed inlet 40. As seen, feed inlet 40 is mounted on cuttings box 10. Hoses (or similar flow conduits) connect cuttings box 10 to the cuttings source, and to vacuum source 200. Preferably, a buffer tank 300 is provided intermediate cuttings box 10 and vacuum source 200, to drop out liquids and/or cuttings which may have bypassed cuttings box 10.

Method of Use

While various methods of use of the present invention are possible, and depend to some extent on the particular embodiment of the apparatus in question, one exemplary method of use and sequence of operation can be described.

Starting the sequence of operations with an empty cuttings box 10: cuttings box 10 is placed in a desired position with respect to the drilling rig. Hatch lid 34 is unlatched and opened. Feed inlet 40 is inserted into hatch opening 30, to the position shown in FIG. 3, with inlet conduit 42 within tank 10, and outlet conduit 44 inserted through hatch opening 34 until collar 52 abuts the edge of relief hatch opening and gasket 54 seals in hatch opening 30. The vacuum source can then be started, which starts pulling air through the system, as indicated by the arrows in FIG. 3. The air stream carries a stream of drill cuttings and air through inlet conduit 42 into box 10, where drill cuttings fall into box 10. The air is pulled through the annulus between inlet conduit 42 and outlet conduit 44, out discharge opening 46, and through vacuum hose 48, through buffer tank 300 to the vacuum source. Gasket 54 tends to seal more tightly as air flow and consequently vacuum within the box is established.

Once cuttings box 10 is filled, the vacuum source is stopped, at which point feed inlet 40 can be readily and simply pulled out of hatch opening 32. Handle 50 eases handling of feed inlet 40. As it is understood that in the preferred embodiment vacuum hose 48 and cuttings hose 100 are relatively flexible, feed inlet 40 can be easily moved around. Hatch 30 is then closed, and the feed inlet 40 is inserted into an empty cuttings box as needed.

It can be readily understood by the foregoing description that the present invention poses considerable time and effort savings over the prior art method of unbolting cuttings box lids, rotating the lids open and then closed, re-bolting the lids, manipulating the false lids from box to box, etc. An important additional result is greatly reduced personal injuries.

Materials and Dimensions

Materials for fabrication of the feed inlet and associated components are well known in the relevant field, and may include steel, various plastics, resilient material for the gasket, etc.

Dimensions can be altered to suit particular applications. By way of example only, with a hatch opening of approximately 10.5" diameter (which is typical), inlet 42 may have a nominal diameter of approximately 6", with a diameter of baffles 43 (at its lowermost end or positioned along the length of inlet 42) of approximately 10.0" to just under 10.5"; discharge opening on housing 44 may be approximately 6"; and housing 44 may be approximately 10.5" in diameter, or just small enough to be readily inserted into hatch opening 30.

Inlet 42 may extend down into cuttings box 10 approximately 10 to 12 inches. Those having ordinary skill in the relevant art will recognize that variations in these dimensions are possible to suit particular applications.

Alternate Embodiments of the Combined Feed Inlet/Outlet

While the embodiments set out above show an annular arrangement of the inlet and discharge conduits, it is possible to configure the combined conduits in different manners. A key aspect of the invention is that it maximizes use of the cross section area of a typical hatch opening, and the available area is therefore "occupied" or used for flow area (either inlet or outlet). Different configurations are therefore possible to yield this result.

Figure 8:
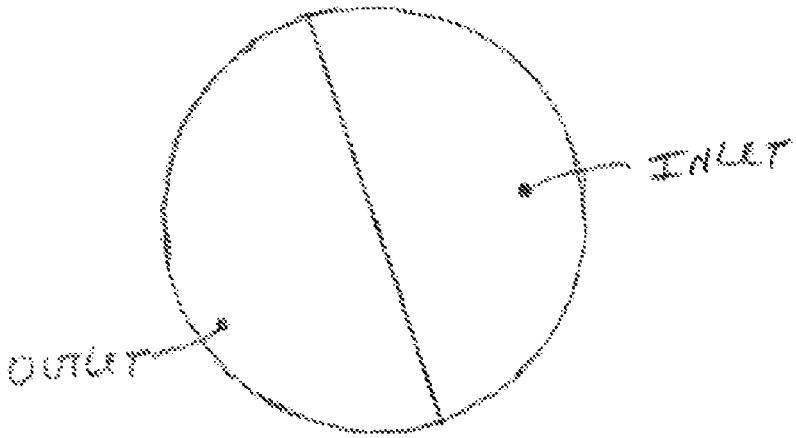
FIGS. 8 and 9 show alternate arrangements of the inlet and discharge areas of an apparatus embodying the principles of the present invention.

FIG. 8 is a cross section view of an embodiment of the combined cuttings feed inlet/air outlet wherein the inlet and outlet conduits are not nested one within the other, so as to form an annular space, but instead the conduits are positioned alongside one another. In the embodiment in FIG. 8, each conduit comprises, in cross section, a half circle, with the two conduits positioned adjacent to one another and sized so as to substantially fill the available cross section space. It is to be understood that many alternate cross section shapes are possible, placed one next to the other, so as to utilize the available total flow area.

Figure 9:
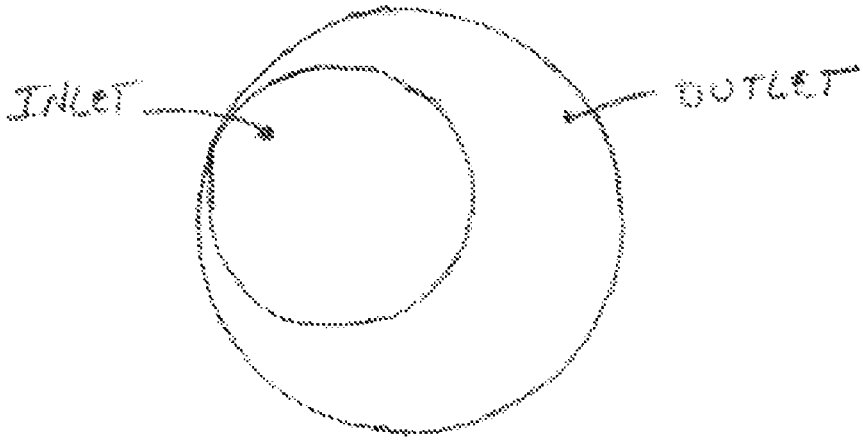

FIG. 9 shows an annular arrangement of the inlet and outlet conduits, but wherein the inner conduit (whether inlet or outlet) is not centralized within the outer conduit.

The inlet and outlet conduits in FIGS. 8 and 9 are labeled for example only. It is to be understood that the respective flow paths can be "reversed," that is either conduit can serve as either the inlet or outlet.

It is understood that other embodiments of the present invention are possible, and within the scope of the claimed invention.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. For example:

- the inlet and outlet conduit positioning can be reversed
- many different cross section shapes are possible for the inlet and outlet conduits
- materials for the feed inlet may be varied—e.g. metals, composites, etc.
- sizes, shapes and capacities may be varied to suit particular applications.

Therefore, the scope of the invention is to be determined not by the illustrative examples set forth above, but by the appended claims and their legal equivalents.

I claim:

1. A combined cuttings stream inlet and air outlet apparatus for placement within the hatch opening of a drill cuttings box, comprising:

an inlet conduit carrying said cuttings stream into said drill cuttings box, said inlet conduit having a cross section area;

an outlet conduit carrying said air stream out of said drill cuttings box, said outlet conduit having a cross section area, whereby said cross section areas of said inlet conduit and said outlet conduit are arranged so as to maximize use of the cross section area of said hatch opening, wherein said inlet and outlet conduits comprise differently sized cross sections, the smaller cross section disposed within the larger cross section.

2. The apparatus of claim 1, whereby the larger conduit forms an annular flow area around the smaller conduit.

3. The apparatus of claim 2, wherein the smaller conduit is concentric within the larger conduit.

4. The apparatus of claim 1, wherein said inlet and outlet conduits are circular in cross section.

5. A combined cuttings stream inlet and air outlet for placement within the hatch opening of a drill cuttings box, comprising:

a cuttings stream inlet conduit disposed within an air stream outlet conduit, forming an annulus around said cuttings stream inlet conduit, said annulus comprising an air stream outlet, said air stream outlet conduit sized and shaped to closely fit within the hatch opening;

a means for connecting said cuttings stream inlet to a cuttings stream source;

a means for connecting said air stream outlet to a vacuum source; and a means for forming at least a partial air seal between said air stream outlet conduit and said hatch opening.

6. The apparatus of claim 5, further comprising one or more baffles disposed on a portion of said cuttings stream inlet within said drill cuttings box.

7. The apparatus of claim 6, wherein said cuttings stream inlet conduit and said air stream outlet conduit comprise concentric circular cross sections.

8. The apparatus of claim 7, wherein said means for connecting said air stream outlet to a vacuum source comprises a buffer tank.

* * * * *